United States Patent [19]

Gravely et al.

[11] Patent Number: 4,557,280

[45] Date of Patent: Dec. 10, 1985

[54] PROCESS FOR REDUCTION OF NITRATE AND NICOTINE CONTENT OF TOBACCO BY MICROBIAL TREATMENT

[75] Inventors: Lawrence E. Gravely, Louisville, Ky.; Vernon L. Geiss, Floyd Knobs, Ind.; Charles F. Gregory, Middletown, Ky.

[73] Assignee: Brown & Williamson Tobacco Corporation, Louisville, Ky.

[21] Appl. No.: 916,322

[22] Filed: Jun. 15, 1978

[51] Int. Cl.[4] ..... A24B 3/14; A24B 15/02

[52] U.S. Cl. ..... 131/297; 131/308; 131/356; 131/370; 435/267

[58] Field of Search ..... 131/143, 308, 297, 370–375, 131/356; 210/601, 603, 605; 435/172, 262, 267

[56] References Cited

U.S. PATENT DOCUMENTS 3,829,377 8/1974 Hashimoato ..... 210/11

3,847,164 11/1974 Mattina et al. ..... 131/143

4,131,118 12/1978 Gellatly et al. ..... 131/143

*Primary Examiner*—V. Millin

*Assistant Examiner*—Gregory Beaucage

*Attorney, Agent, or Firm*—Charles G. Lamb

[57] ABSTRACT

A process for the reduction of the nitrate and nicotine contents of tobacco by microbial treatment is disclosed wherein tobacco materials are subjected, under controlled conditions, to the action of a microorganism effective to degrade nitrates and alkaloids (nicotine) through a biochemical reaction. The microorganism is combined or grown in the presence of a nitrate containing compound in relatively small quantities. Tobacco treated in accordance with this process has a reduced nitrate and nicotine content, and when incorporated into a tobacco smoking product thereby produces a mild smoke, having reduced nitrogen oxides, hydrogen cyanide and nicotine content. However, there is no loss of desirable flavor, taste and smoking properties.

35 Claims, No Drawings

PROCESS FOR REDUCTION OF NITRATE AND NICOTINE CONTENT OF TOBACCO BY MICROBIAL TREATMENT

BACKGROUND OF THE INVENTION (A) Field of the Invention

The present invention relates to a process of reducing the nitrate and nicotine contents of tobacco by treating the tobacco with a culture of a microorganism. More specifically, the invention relates to a process for treating tobacco to reduce the nitrate and nicotine contents thereof, which, when incorporated into a tobacco smoking product, yields smoke with reduced nitrogen oxides, hydrogen cyanide and nicotine deliveries without loss of desirable flavor and taste properties or other smoking qualities.

(B) Prior Art

For various reasons, it is often desirable to reduce the nitrate and nictone contents of tobacco. For example, in recent years, low nicotine content cigarettes have gained substantial consumer acceptance. Also, demand has increased for low delivery cigarettes and numerous techniques have become available for reducing either the nitrate content or the nicotine content of tobacco.

In the removal or reduction of the nitrate content, the most common method has included the use of chemical agents in selective nitrate removal from tobacco extracts by ion retardation techniques. Reduction of nicotine content from tobacco has been accomplished by both chemical means as well as by microbial treatment. U.S. Pat. No. 4,011,141; U.S. Pat. No. 4,037,609; and, U.S. Pat. No. 4,038,993 teach microbial treatment means for the reduction of the nicotine content of tobacco. However, there is no treatment known which enables selective simultaneous reduction of both the nitrate and nicotine content of tobacco in one treatment without reducing all flavor components, particularly one including the use of microorganisms.

SUMMARY OF THE INVENTION

It is an object of the present invention to provide a process for reducing the nitrate and nicotine content of tobacco. It is another object of this invention to provide a process for the preparation of an aqueous medium containing a microorganism which may be used for the degradation of nitrate and nicotine content of tobacco materials. Other objects and advantages of this invention will become apparent to those skilled in the art upon consideration of the accompanying disclosure.

The present invention resides in the recognition that certain microorganisms in an aqueous solution, when coming in contact with tobacco, degrade the nitrate and nicotine content of the tobacco. It has been found that tobacco material treated with a pure culture of a microorganism grown in a nitrate-containing medium degrades both nitrate and alkaloids (nicotine) in tobacco materials simultaneously. In so doing, a tobacco material is produced that, when placed in a blended cigarette, contributes to decreasing deliveries of nitrogen oxides, hydrogen cyanide, and nicotine. The preferred culture is *Cellulomonas* sp. as described in U.S. Pat. No. 4,038,993, which is incorporated herein by reference and includes a preferred nitrate-containing compound added to the growth media, potassium nitrate. However, it is realized that other cultures may be used and other nitrate-containing compounds, such as sodium nitrate, ammonium nitrate, and the like may also be used.

Using the culture of the present invention, it is practical to treat tobacco lamina or stem and remove nitrate and nicotine simultaneously or to make a water extract of either material and remove nitrate and nicotine and then reapply treated extract to the original tobacco materials or a reconstituted tobacco. The capability of treating the extract and then reapplying it to the original tobacco avoids the solubles weight loss encountered when using water extraction and discard as a vehicle for removing nitrate and nicotine. It also avoids the loss of other desirable tobacco components encountered in water extraction and discard. The process of the present invention also offers potential for removing both nitrate and nicotine in reconstituted tobacco production systems, wherein the tobacco is extracted and the extract is added back in subsequent process steps, since this enzyme (microbial) system functions efficiently in a liquid system. In the process, the nitrate is broken down and converted to gaseous nitrogen, which is released to the atmosphere. It has been found that the pH of the aqueous medium containing the microorganism prior to the addition to the tabacco materials must be maintained in the range of at least greater than 5.6 in order to provide a microorganism which will successfully and simultaneously degrade nitrates and nicotine. The preferred initial pH of the aqueous medium is about 7 to 9.5. It has also been found that the nitrate containing compound in the aqueous medium must be at least about 0.1 percent by weight in the medium and preferably about 1 percent. Even though higher percentages of nitrate-containing materials may be used, increasing the nitrate-containing compound in excess of 1 percent by weight does not appreciably assist in the degrading capabilities of the microorganisms, although higher concentrations are usable and the organism will degrade nitrate compounds at higher concentrations.

DESCRIPTION OF THE PREFERRED EMBODIMENTS

According to the present invention, one preferred method for simultaneously reducing the nitrate and nicotine content of tobacco is to prepare an aqueous medium containing microorganisms.

In the preparation of an aqueous medium, a nutrient agar (first) solution is prepared by adding a commercially available nutrient agar to distilled water, the amount of agar generally being at least 5 grams per liter. To this is added a nitrate-containing compound, preferably potassium nitrate, which is at least 0.1 percent by weight of nitrate per volume of water and is generally about 1 percent by weight of nitrate per volume of water. This solution is then sterilized as tubed slants; that is, thest tubes containing the nutrient agar are placed at a slant to provide a slanted surface, in an autoclave for at least fifteen minutes and at least 15 psig and at least 121° C. The sterilized medium is then placed in a refrigerator for later use.

A second solution is then prepared which includes nicotine and a nitrate containing substance therein which is to be treated by the culture grown in the sterilized medium. One such second solution may be a nutrient broth containing only nitrates therein which is prepared by dissolving a commercially available nutrient broth in distilled water, the amount of nutrient broth being from about 5 to 10 grams per liter. However, it is realized that those skilled in the art may vary the nutrient broth concentration and achieve a useable culture. This solution is also sterilized for at least 15 minutes at at least 15 psig and 121° C. or greater in an autoclave. Potassium nitrate or other nitrate-containing compounds may be added to this solution prior to the sterilization.

Another example of a second solution may be a tobacco extract broth containing both nitrates and nicotine. The tobacco extract broth is prepared by taking usually about 100 grams of tobacco material, such as, a flue-cured burley stem mixture and mixing this with about 1,000 milliliters of water and then cooking the mixture in an autoclave for at least 30 to 60 minutes at at least 15 psig and 121° C. or greater. The resultant liquid extract is then removed and the liquid volume is adjusted to the original amount of the extract by adding distilled water. The extract is then mixed with yeast extract, the yeast extract being generally at least 0.3 percent by weight to volume of liquid. However, greater amounts of yeast extract may be used if desired. The mixture is dispensed into flasks that are cotton-plugged and sterilized for at least 15 minutes at 15 psig or greater and 121° C. or greater for subsequent culture propagation. Prior to use for culture growth, the pH is adjusted with appropriate acid or base to about 7.2.

The microorganism, preferably *Cellulomonas* sp., is incubated on nutrient agar slants, including the nitrate-containing compound, for 3 to 5 days at 20° C. to 40° C. The resultant growth is then used to inoculate the tobacco extract broth, the inoculum being removed from the slants by washing the slant surface with a predetermined amount of sterile distilled water. The tobacco extract broth is then subjected to agitation for generally about 24 hours at about 20° C. to 40° C. to promote growth of the microorganism which was added. Lesser or greater growth periods, up to as long as about 48 hours, are acceptable.

The resultant inoculum is then ready for use in the treatment of additional tobacco materials to reduce the nitrate and nicotine content thereof.

A more comprehensive understanding of the invention can be obtained by considering the following examples. However, it should be understood that the examples are not intended to be unduly limitative of the invention.

EXAMPLE 1

The following example demonstrates the procedure that was followed in the preparation of inoculum.

(a) Nutrient agar+1.0% potassium nitrate.

Commercially prepared Nutrient Agar (dehydrated form) from Difco Laboratories was added to distilled water in the ratio of 23 grams per liter. The 23 grams of nutrient agar contained 3 grams of beef extract; 5 grams of peptone and, 15 grams of agar. To this solution was added 1% of potassium nitrate by weight to volume of water. The resulting solution had a final pH of 6.8.

This medium was then sterilized as tubed slants in an autoclave for 15 minutes at 15 psig and 121° C. and refrigerated for later use to grow cultures.

(b) Nutrient Broth.

A solution of Nutrient Broth media, was prepared by adding dehydrated Nutrient Broth from Difco Laboratories at a rate of 8 grams per liter to distilled water. The Nutrient Broth contained 5 grams of peptone and 3 grams of beef extract. The resulting aqueous medium was then sterilized for 15 minutes at 15 psig and 121° C. for later use in culture growth.

(c) Flue-Cured/Burley Stem Tobacco Extract Broth.

A flue-cured/burley stem tobacco extract broth was prepared by adding 100 grams of flue-cured/burley stem to 1000 ml of water and cooked in an autoclave for 40 minutes at 15 psig and 121° C. The resultant liquor extract was removed and the liquid volume was adjusted to its original amount with distilled water. The liquor was then mixed with yeast extract at a rate of 0.5% by weight of yeast extract per volume of liquor and the mixture dispensed into flasks which were then cotton-plugged and sterilized for 15 minutes at 15 psig and 121° C. for culture propagation.

(d) Broth Inoculation.

The microorganism, *Cellulomonas* sp., is incubated on the nutrient agar slants for from 3 to 5 days at 30° C. Liquid media, for example, Nutrient Broth or flue-cured/burley stem tobacco extract broth are inoculated with a sterile water wash from slants at a 2% (v/v) rate. The pH of the broth prior to inoculation is adjusted with hydrochloric acid or sodium hydroxide to a pH of 7.2 to 7.5. The flasks are then subjected to rotary agitation for approximately 24 hours at 30° C. and 220 rpm.

EXAMPLE 2

This example demonstrates the nitrate and nicotine degradation that occurs in burley stem extract at different pH levels.

A water extract of burley stem was prepared according to the procedure described in Example 1(c) and dispensed into 500 ml Erlenmeyer flasks at 250 ml/flask. These media were used to determine nitrate and nicotine degradation capabilities of *Cellulomonas* sp. with the results shown below.

| | pH | $NO_3$ (μg/ml) | Alkaloid (Nicotine) (mg/ml) |
|---|---|---|---|
| Burley Stem Extract Broth - pH 7.2 | | | |
| 0 hours | 7.18 | 220 | 0.32 |
| 7 hours | 7.08 | 80 | 0.04 |
| 25 hours | 7.75 | 0 | 0.02 |
| 30 hours | 8.15 | 0 | 0.02 |
| Burley Stem Extract Broth - pH 5.6 | | | |
| 0 hours | 5.60 | 295 | 0.41 |
| 7 hours | 5.59 | 305 | 0.39 |
| 25 hours | 5.65 | 265 | 0.39 |
| 30 hours | 5.70 | 300 | 0.37 |
| Burley Stem Extract Broth - pH 4.8 | | | |
| 0 hours | 4.82 | 305 | 0.41 |
| 7 hours | 4.85 | 310 | 0.42 |
| 25 hours | 4.90 | 285 | 0.40 |
| 30 hours | 4.80 | 300 | 0.40 |

It can be seen from the above data that *Cellulomonas* sp. at pH of 7.2 degraded most of the nitrate and nicotine available in the extract, whereas at a lower pH (5.6 and 4.8), very little, if any, degradation occurred.

EXAMPLE 3

This example demonstrates nitrate degradation in materials other than tobacco.

*Cellulomonas* sp. was grown under the conditions described below in a Nutrient Broth+0.1% $KNO_3$ medium using a New Brunswick Scientific Fermentor (MF214). The inoculating culture was prepared as in Example 1 using the nutrient agar of Example 1(a) and the nicotine-free nutrient broth of Example 1(b). Growth conditions were:

Agitation (rpm)—300
Aeration (cc/min.)—4,000
Medium—Nutrient Broth+0.1% $KNO_3$ (wt/v)
Medium Volume (L)—8
Temperature (°C.)—30
pH—7.0
Inoc. Rate (v/v)—5%
Inoc. Age (hrs.)—20
Inoc. Medium—Nutrient Broth+0.1% $KNO_3$
Antifoam—P-1200 (Dow Chemical Company)
pH Control—2N HCL, 2N NaOH The following changes in nitrate content occurred:

| Growth Time (hrs.) | $NO_3$ (μg/ml) | pH | Cell Count (× $10^6$) |
|---|---|---|---|
| Inoculum | 138 | 7.70 | 4,100 |
| 1 hr. after inoc. | 126 | 6.90 | 53 |
| 2 hrs. after inoc. | 120 | 7.00 | 350 |
| 4 hrs. after inoc. | 114 | 7.20 | 1,600 |
| 6 hrs. after inoc. | 108 | 7.20 | 1,100 |
| 21 hrs. after inoc. | 132 | 7.18 | 3,400 |
| 29 hrs. after inoc. | 0 | 7.05 | 3,100 |
| 45 hrs. after inoc. | 0 | 7.55 | 4,700 |

It can be seen from the above data that nitrate was removed by the *Cellulomonas* sp. culture prior to 29 hours at a pH of 7.0–7.2.

EXAMPLE 4

This example demonstrates the nitrate and nicotine degradation that occurs in burley extract broth having a relatively high nitrate concentration.

*Cellulomonas* sp. was grown in a New Brunswick Fermentor (MF214) in burley extract broth prepared as in Example 1(c). Conditions for growth were the same as in Example 3 except that the growth medium was burley extract broth.

The following changes in nitrate and alkaloid content occurred:

| Growth Time (hrs.) | $NO_3$ (μg/ml) | Alkaloid (Nicotine) (mg/ml) | pH |
|---|---|---|---|
| Before Inoculation | 4,680 | 0.430 | 6.55 |
| Inoculum | 0 | 0.028 | 8.14 |
| After Inoculation | 4,380 | 0.240 | 7.02 |
| 1 hr. after inoc. | 4,500 | 0.202 | 6.90 |
| 2 hrs. after inoc. | 4,380 | 0.136 | 6.91 |
| 4 hrs. after inoc. | 4,200 | 0.036 | 7.18 |
| 6 hrs. after inoc. | 2,910 | 0.040 | 7.62 |
| 8 hrs. after inoc. | 2,040 | 0.038 | 7.57 |
| 9 hrs. after inoc. | 2,040 | 0.038 | 7.82 |
| 24 hrs. after inoc. | 1,350 | 0.040 | 7.20 |
| 26 hrs. after inoc. | 1,320 | 0.040 | 7.22 |
| 30 hrs. after inoc. | 1,380 | 0.036 | 7.21 |
| 48 hrs. after inoc. | 900 | 0.034 | 7.05 |
| 50 hrs. after inoc. | 900 | 0.034 | 7.00 |

It can be seen from the above data that *Cellulomonas* sp. degraded most of the nitrate and nicotine available in the extract.

EXAMPLE 5

This example demonstrates different levels of a nitrate-containing compound that may be used in the growing of a microorganism for degrading nitrates.

*Cellulomonas* sp. was grown in a nicotine free nutrient broth (NB)+0.1% $KNO_3$ prepared as in Example 1(b). The culture was used to inoculate nutrient broth with varying levels of $KNO_3$ added on a wt/vol basis. The following changes occurred during agitation of these cultures at 30° C. and 160 rpm (rotary).

| $NO_3$ (μg/ml) | | pH | |
|---|---|---|---|
| 0 hrs. | 25 hrs. | 0 hrs. | 25 hrs. |
| Inoculated | | | |
| 335 | 155 | 6.97 | 8.17 |
| 500 | 240 | 7.00 | 7.95 |
| 3,000 | 2,370 | 6.95 | 8.05 |
| 4,980 | 4,560 | 6.92 | 8.15 |
| Control - Uninoculated | | | |
| 460 | 400 | 6.99 | 7.19 |

It can be seen that *Cellulomonas* sp. degraded a portion of the nitrate at all initial nitrate concentrations from 335 μg/ml to 3000 μg/ml nitrate in Nutrient Broth and degraded a small amount of the nitrate about 4,980 μg/ml. The slight change in "control" nitrate concentration is close to analytical error. It was not due to microbial action since no culture was added to the control media.

EXAMPLE 6

This example demonstrates the effect of aeration on the cultures growth in tobacco extract.

*Cellulomonas* sp. was grown in a water extract of flue-cured/burley stem, prepared as described in Example 1(c), under the following controlled conditions in a New Brunswick Scientific Fermentor (MF214):

Agitation (rpm)—600
Aeration (cc/min.)—8,000
pH—7.3
Temperature (°C.)—30
Time (hrs.)—22
Antifoam—P-1200 (Dow Chemical Company)
Inoc. Rate (v/v)—5%
Medium (vol.)—8L
Medium Type—Water extract of flue-cured/burley stem. pH was controlled using 2N HCL and 2N NaOH Cell mass increase and chemical changes during growth were:

| Time | Cell Count (× $10^6$/ml) | pH | Nitrate (μg/ml) | Alkaloid (Nicotine) (mg/ml) |
|---|---|---|---|---|
| Before Inoculation | 0 | 7.31 | 1,534 | 0.32 |
| Inoculum | 5,000 | 8.17 | 0 | 0.02 |
| After Inoculation | 350 | 7.40 | 1,486 | 0.30 |
| 1 hr. after inoc. | 490 | 7.40 | 1,448 | 0.27 |
| 3 hrs. after inoc. | 640 | 7.41 | 1,491 | 0.20 |
| 5 hrs. after inoc. | 1,220 | 7.35 | 1,449 | 0.08 |
| 22 hrs. after inoc. | 4,200 | 7.23 | 1,450 | 0.02 |

The above data indicate that under the conditions used, specifically a high (8,000 cc/min) aeration rate, nitrate is not degraded but alkaloids were degraded.

The culture grown in this fashion was used to treat burley lamina as follows:

| Tobacco Dry Wt. (lbs.) | Culture (ml) | NaOH (1N) (ml) | Water (ml) |
|---|---|---|---|
| 3.8 | 2,436 | 379.5 | 2,269 |

Treatment was conducted in a plastic bag (non-aerated environment) at 30° C. for 24 hours with the following results:

| Treatment Time (hrs.) | $NO_3$ (%) | Alkaloids (%) | Moisture (%) | pH |
|---|---|---|---|---|
| 0 | 3.54 | 1.42 | 74.4 | 7.33 |
| 24 | 0.22 | 0.32 | 76.4 | 8.38 |

It can be seen that in a non-aerated environment, the *Cellulomonas* sp. degraded both nitrate and nicotine. The lowered nitrate and nicotine burley tobacco was blended with other tobacco materials and compared to a control blend containing untreated burley tobacco with results as shown below:

| | Blend Chemical Properties | | |
|---|---|---|---|
| | $NO_3$ (%) | Alkaloids (Nicotine) (%) | pH |
| Control** | 1.63 | 1.79 | 5.47 |
| Experimental* | 1.04 | 1.32 | 6.00 |

**Contained untreated burley lamina
*Contained treated burley lamina

These blends were manufactured into cigarettes and machine smoked with the following smoke delivery reductions in nitrogen oxides, hydrogen cyanide and nicotine.

| | Per Puff Deliveries | | | |
|---|---|---|---|---|
| | NOx (μg) | HCN (μg) | Nicotine (mg) | Puffs |
| Control | 54 | 28.4 | 0.13 | 7.3 |
| Experimental | 33 | 22.8 | 0.11 | 7.2 |

The smoke data show: 38.8% reduction in nitrogen oxides (NOx); 19.7% reduction in hydrogen cyanide and a 15.3% reduction in nicotine.

EXAMPLE 7

This example demonstrates the effect of aeration in the culture growth wherein reduced aeration provides the environment for nitrate degradation in liquid systems.

*Cellulomonas* sp. was grown in a water extract of flue-cured/burley stem, prepared as described in Example 1(c), under the following conditions in a New Brunswick Scientific Fermentor (MF214):

Agitation (rpm)—600 (1st 4 hrs.) 300 (last 20 hrs.)
Aeration (cc/min.)—8,000 (1st 4 hrs. only) none (last 20 hrs.)
pH—7.0
Temperature (°C.)—30
Time (hrs.)—24
Antifoam—P-1200 (Dow Chemical Company)
Inoc. Rate (%) (v/v)—5
Medium (vol.)—8L
Medium type—Water extract of flue-cured/burley stem pH was controlled using 2N HCL and 2N NaOH.

Cell mass increase and chemical changes during growth were:

| Time | Cell Count ($\times 10^6$) | pH | Nitrate (μg/ml) | Alkaloid (Nicotine) (mg/ml) |
|---|---|---|---|---|
| Before Inoculation | * | 7.12 | 3,173 | 0.48 |
| Inoculum | 7,400 | 7.40 | 50 | 0.05 |
| After Inoculation | 155 | 7.27 | N.D. | N.D. |
| 1 hr. after inoc. | 430 | 7.25 | N.D. | N.D. |
| 2 hrs. after inoc. | 410 | 7.17 | N.D. | N.D. |
| 3 hrs. after inoc. | 840 | 7.14 | 2,534 | N.D. |
| 4 hrs. after inoc. | 1,040 | 7.02 | 1,171 | 0.06 |
| 6 hrs. after inoc. | 1,490 | 7.08 | 50 | N.D. |
| 8 hrs. after inoc. | 2,500 | 7.15 | 50 | 0.06 |
| 24 hrs. after inoc. | 8,000 | 7.34 | 50 | 0.06 |

*Slight contamination
N.D. = No Analysis

The above data indicate that under the conditions used, specifically an initial high aeration rate (4 hrs.), and then no appreciable aeration (20 hrs.), both nitrate and alkaloids were degraded. More specifically, it can be seen that the nitrate degradation started very soon after the aeration was discontinued.

The culture grown as described in this example was used to treat a flue-cured/burley stem mixture for 27 hours by applying inoculum at a rate of 2.4 mls./gram tobacco weight and incubating the tobacco at 30° C. The following chemical changes typically occurred:

| Treatment Time (hrs.) | $NO_3$ (%) | Alkaloids (%) |
|---|---|---|
| 0.0 | 2.8 | 0.34 |
| 6.5 | 2.3 | No Data |
| 27.0 | 0.4 | 0.06 |

The treated tobaccos were blended with other tobacco materials and compared to a control blend, which contained untreated stems, as shown below for two different inclusion levels of treated materials:

| | Blend Chemical Properties | | | |
|---|---|---|---|---|
| Sample | Stem Inclusion Levels | $NO_3$ (%) | Alkaloids (Nicotine) (%) | pH |
| Control | Normal | 1.33 | 1.85 | 5.45 |
| | 2.5× normal | 1.67 | 1.47 | 5.48 |
| Experimental* | Normal | 0.85 | 1.79 | 5.77 |
| | 2.5× normal | 0.69 | 1.26 | 6.42 |

*Contained treated stem materials.

These blends were manufactured into cigarettes and machine smoked with the following differences resulting between control and experimental products:

| | | Per Puff Deliveries | | | |
|---|---|---|---|---|---|
| Sample | Stem Inclusion Levels | NOx (μg) | HCN (μg) | Nicotine (mg) | Puffs |
| Control | Normal | 44.4 | 24.4 | 0.13 | 8.8 |
| | 2.5× normal | 51.8 | 18.7 | 0.11 | 8.3 |
| Experimental | Normal | 32.2 | 19.1 | 0.13 | 9.5 |
| | 2.5× normal | 20.7 | 7.4 | 0.09 | 10.0 |

The smoke delivery data show: 27% and 60% reductions in nitrogen oxides and 21.7% and 60.4% reductions in hydrogen cyanide for normal and 2.5× normal inclusion rates of treated stem material. The data also reflect a significant increase in puff number where treated materials were incorporated into the blend at 2.5× normal rate.

EXAMPLE 8

This example demonstrates the procedure used for extracting tobacco lamina with water to remove nitrate and nicotine, treating the extract with *Cellulomonas* sp. to remove the nitrate and nicotine, followed by adding the modified extract back to the original tobacco.

A tobacco extract was prepared by mixing 100 gms. of burley lamina with one liter of water and allowing it to stand at room conditions for two hours. At this point, the extract was collected by decanting the liquid and pressing the tobacco to remove additional liquid. The tobacco was spread to dry in room air while the extract (700 ml) was subjected to microbial treatment as discussed hereinafter.

A mature culture of *Cellulomonas* sp. was grown in a separate tobacco extract medium, prepared as described in Example 1(c) and added to the tobacco extract as described above, at a 10% (v/v) rate. Prior to adding the culture, the extract pH was raised to 7.0±0.1. The culture was incubated in the extract in an Erlenmeyer flask on a rotary shaker at 30° C. The following chemical changes occurred across the 18 hour incubation time:

Cellulomonas sp. Treatment of Burley Lamina Extract

| | $NO_3$ (μg/ml) | Alkaloid (Nicotine) (mg/ml) |
|---|---|---|
| Burley lamina extract | 1,872 | 1.47 |
| Mature Cellulomonas sp. culture | 0 | 0 |
| Extract after treatment | 66 | 0.09 |

It can be seen that nitrate and nicotine were almost completely degraded (96.5% and 93.9%, respectively) in view of the treatment.

After 18 hours, the treated extract was added back to the originally extracted tobacco in three stages because of the large amount of extract involved. This was done by adding a portion, mixing thoroughly, and air drying prior to the next addition. The following chemical changes occurred during these procedures:

Tobacco Analysis

| | $NO_3$ (%) | Alkaloid (Nicotine) (%) |
|---|---|---|
| Burley Lamina Before Extraction | 1.96 | 2.46 |
| Burley Lamina After Extraction | 0.72 | 0.97 |
| Burley Lamina After Treated Extract Addback | 0.39 | 0 |

It can be seen that the nitrates and alkaloids (nicotine) are removed from the extract and, therefore, are significantly lowered in the tobacco to which treated extract is added back. 80% of the nitrate and 100% of the alkaloids were removed by this method. Part of the nitrate and alkaloids are removed from the tobacco by the culture during drying following addback.

The tobaccos resulting from this operation were usable in manufacturing type operations.

EXAMPLE 9

This example demonstrates some differences in the final product which can be obtained by using ultrafiltration equipment in conjunction with tobacco extraction, extract treatment and extract addback as described in Example 8. Tobacco used in this example was the same as that used in Example 8.

A burley lamina extract was prepared as in Example 8. The extract was then filtered with a 0.2 micron pore size filter in an Amicon ultrafiltration device (Model TCF10) prior to inoculating the filtered extract with *Cellulomonas* sp. and treating it as described in Example 8. Following treatment, the extract was again filtered before addback procedures were started. The materials retained on the filter during the first filtration were also added back to the extracted tobacco.

The materials retained by the filter during the second filtration were not added back to the tobacco. The following chemical changes occurred in the extract:

Chemical Changes Across Ultrafiltration and Cellulomonas sp. Treatment of Burley Extract

| | $NO_3$ (μg/ml) | Alkaloid (Nicotine) (mg/ml) |
|---|---|---|
| Burley Lamina Extract | 1,872 | 1.47 |
| Mature Cellulomonas sp. Culture | 0 | 0 |
| Extract After Filtration | 2,028 | 1.48 |
| Extract After Cellulomonas sp. Treatment | 110 | 0.12 |

The following chemical changes were measured in the extracted tobacco across extraction and treatment:

Tobacco Analysis

| Burley Lamina | $NO_3$ (%) | Alkaloid (Nicotine) (%) |
|---|---|---|
| Before Extraction | 1.96 | 2.46 |
| After Extraction | 0.72 | 0.79 |
| After Treated Extract Added Back | 0.75 | 0.72 |

It can be seen that nitrates and alkaloids (nicotine) are removed from the extract by *Cellulomonas* sp. but, as opposed to Example 8, no further removal from the extracted tobacco occurs during addback procedures. In this example, the microbial culture never comes into contact with the tobacco, whereas in Example 8, the culture does contact the tobacco during addback.

The tobaccos resulting from this operation were usable in manufacturing type operations.

EXAMPLE 10

This example demonstrates the effectiveness of *Cellulomonas* sp. in removing nitrate and nicotine from reconstituted tobacco materials.

A water extract broth was prepared as follows: 150 g of reconstituted tobacco was pulped in one liter of water in a Waring blender for one minute. Following this pulping, the mixture was held at room temperature for 10 minutes after which the liquid was centrifugally separated and brought back to the original volume with distilled water for sterilization at 121° C. and 15 psig for 15 minutes. Separate preparations were made to which yeast extract (YE) was added at 0.5% (wt/vol) rate prior to sterilization. Flue-cured/burley stem extract (with 0.5% yeast extract) was prepared as in Example 1(c) and was used for "Control" extract. The broths' pH was adjusted to 7.2 prior to inoculation with *Cellulomonas* sp.

The following results were obtained:

| Growth Time (hrs.) | $NO_3$ (mg/ml) | Alkaloids (Nicotine) (mg/ml) | pH |
|---|---|---|---|
| | Control | | |
| 0 | 2,246 | 0.23 | 7.30 |
| 24 | 0 | 0 | 8.50 |
| 48 | 0 | 0 | 8.12 |
| | Experimental | | |
| Without Yeast Extract | | | |
| 0 | 1,859.0 | 1.12 | 7.34 |
| 24 | 1,641.0 | 0.88 | 7.46 |
| 48 | 39.0 | 0.08 | 8.08 |
| With Yeast Extract | | | |
| 0 | 1,878.0 | 1.09 | 7.21 |
| 24 | 0.28 | 0.35 | 8.04 |
| 48 | 0.14 | 0.06 | 8.17 |

It can be seen that the culture can effectively degrade the nitrate and alkaloids (nicotine) of reconstituted tobacco materials with or without the addition of yeast extract.

EXAMPLE 11

This example demonstrates the effects of aerobic and anaerobic tobacco treatments.

*Cellulomonas* sp. was grown in flue-cured/burley extract broth, prepared as described in Example 1(c) but without yeast extract added, for 25.5 hrs. in a New Brunswick Scientific Fermentor (MF214) under the following conditions:

| | |
|---|---|
| Agitation (rpm) - 600 (1st 4 hrs.) 300 (last 21.5 hrs.) | |
| Aeration (cc/min.) - 8.000 (1st 4 hrs.) 0 (last 21.5 hrs.) | |
| Medium - Flue-cured/burley extract broth | |
| Medium Volume (L) - 8 | |
| Temperature (°C.) - 30 | |
| pH - 7.0 | |
| Inoculum Rate (% v/v) - 5 | |
| Inoculum Age (hrs.) - 22 | |
| Antifoam - P-1200 (Dow Chemical) | |
| Inoculum Agitation Rate (rpm) - 160 | Inoculum for MF214 Growth Cycle |
| Inoculum Medium - Flue-cured burley extract broth | Inoculum for MF214 Growth Cycle |

| Time (hrs.) | (μg/ml) | Alkaloid (mg/ml) | pH |
|---|---|---|---|
| Initial | 3,565 | 2.84 | 7.15 |
| 25.5 | 0 | 0.24 | 7.06 |

At 25.5 hrs., the culture was used to treat flue-cured/burley stem under aerobic and anaerobic conditions with the following results:

| | Aerobic Treatments Time (hrs.) | | | | |
|---|---|---|---|---|---|
| | 0 | | | 24 | |
| | pH | $NO_3$ (%) | Alkaloids (%) | $NO_3$ (%) | Alkaloids (%) |
| Treated | 6.48 | 2.75 | 0.17 | 0.12 | 0.10 |
| Treated | 7.53 | 2.75 | 0.17 | 0.13 | 0.09 |
| Control | 5.20 | 2.75 | 0.17 | 2.72 | 0.12 |

| | Anaerobic Treatments Time (hrs.) | | | | |
|---|---|---|---|---|---|
| | 0 | | | 24 | |
| | pH | $NO_3$ (%) | Alkaloids (%) | $NO_3$ (%) | Alkaloids (%) |
| Treated | 6.82 | 2.75 | 0.17 | 0.12 | 0.09 |
| Treated | 7.22 | 2.75 | 0.17 | 0.15 | 0.09 |
| Control | 5.20 | 2.75 | 0.17 | 2.78 | 0.19 |

All treatments were at 75% moisture content and conducted at 30° C. for 24 hours in plastic bags. Also, anaerobic treatments were conducted in BBL (Baltimore Biological Laboratories) "GASPAK" anaerobic system jars using BBL catalyst for tying up atmospheric oxygen.

It is seen from the above data that the present invention can be carried out under anaerobic conditions and under conditions when availability of oxygen is not controlled.

EXAMPLE 12

This example demonstrates the effects of treating tobacco with cells as well as supernatant liquor from the cell growth.

*Cellulomonas* sp. was grown in flasks of flue-cured/burley stem extract broth, with 0.5% (wt/vol) yeast extract added, prepared as in Example 1(c).

Flask inoculation and incubation were conducted as described in Example 1(d). At the end of the growth period, the culture was processed as shown in the FIG. 1.

FIG. 1

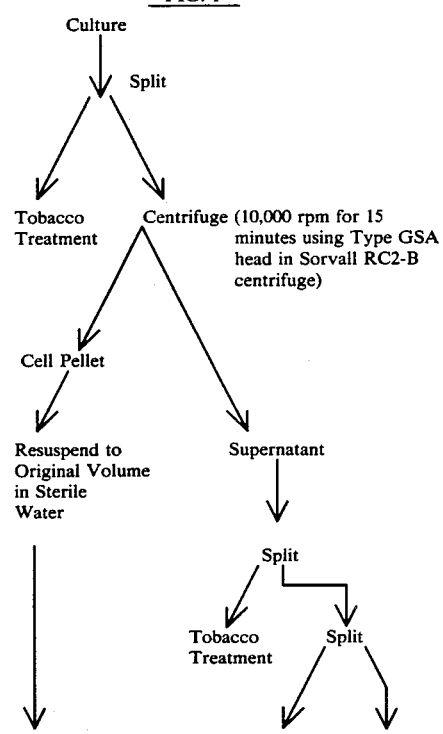

-continued

FIG. 1

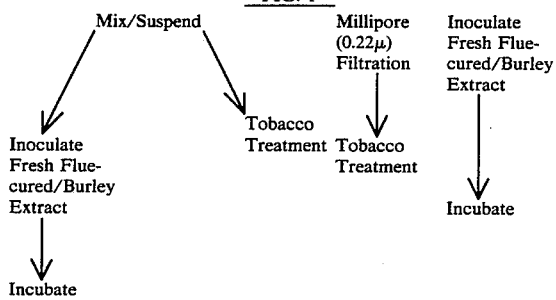

The following resulted from the operation shown in the FIGURE.

TABLE 1

| CULTURE PREPARATION | | $NO_3$ ($\mu g^3$/ml) | Alkaloids (mg/ml) | pH |
|---|---|---|---|---|
| Flue-cured/Burley Extract Broth with 0.5% YE | | | | |
| Control | 0 hrs. | 1618 | 0.290 | 7.13 |
| (uninoculated) | 24 hrs. | 1550 | 0.290 | 7.04 |
| Inoculated | 0 hrs. | 1559 | 0.280 | 7.11 |
| | 24 hrs. | 39 | 0.028 | 8.06 |
| Resuspended cells | | 0 | 0 | 8.32 |
| Supernatant | | 36 | 0.026 | 8.16 |
| Filtered Supernatant | | 40 | 0.026 | 8.27 |

Resuspended cells and filtered supernatant were used to inoculate separate fresh flasks of flue-cured/burley extract broth at 10 ml/flask (250 ml extract/500 ml flask) and incubated at 30° C. for 24 hours at 220 rpm. Extract was prepared as in Example 1(c). The following was obtained:

TABLE 2

| | Time(hrs) | $NO_3$ (μg/ml) | Alkaloids (mg/ml) | pH |
|---|---|---|---|---|
| Resuspended cells | 0 | 1482 | 0.27 | 7.02 |
| | 24 | 0 | 0 | 8.15 |
| Filtered Supernatant | 0 | 1522 | 0.27 | 7.21 |
| | 24 | 1022 | 0.30 | 7.75 |

Resuspended cells, original culture, filtered supernatant and unfiltered supernatant were all used separately to treat 50 gm samples of flue-cured/burley stem at about 75% moisture for 24 hours at 30° C. in plastic bags. A control sample was pH adjusted and water treated without inoculum. The following results were obtained:

TABLE 3

| TOBACCO TREATMENTS | Time (hrs) | $NO_3$ (%) | Alkaloids (Nicotine) (%) | pH |
|---|---|---|---|---|
| Control (no inoculum) | 0 | 4.34 | 0.59 | 6.83 |
| | 24 | 4.12 | 0.37 | 6.99 |
| Original culture | 0 | 4.48 | 0.56 | 7.22 |
| | 24 | 0.61 | 0.05 | 8.54 |
| Resuspended cells | 0 | 4.33 | 0.56 | 7.03 |
| | 24 | 2.72 | 0.18 | 8.06 |
| Supernatant | 0 | 4.65 | 0.56 | 7.25 |
| | 24 | 4.51 | 0.42 | 7.24 |
| Filtered supernatant | 0 | 4.46 | 0.57 | 7.26 |
| | 24 | 4.04 | 0.49 | 7.12 |

It can be seen from the above data that the supernatant liquor when separated from the culture, does not provide the capability for degradation of nitrates and nicotine in tobacco.

What is claimed:

1. A process for reducing the nitrate and nicotine content of tobacco comprising:

(a) contacting tobacco with an aqueous medium containing a nitrate containing compound and a microorganism which degrades the nitrate and nicotine content of said tobacco, said microorganism being *Cellulomonas* sp.; and, (b) maintaining said tobacco in contact with said microorganism for about 18 hours at a temperature of from about 20° C. to about 40° C.

2. The process of claim 1 wherein said nitrate compound is selected from the group consisting of potassium nitrate, sodium nitrate, and ammonium nitrate.

3. The process of claim 1 wherein said nitrate compound is in the range of from about 0.1 to 1.0 percent by weight of said aqeous medium.

4. The process of claim 1 wherein said contacting is carried out at a pH of from about 7.0 to 9.5.

5. The process of claim 1, said aqueous medium being prepared by:

(a) adding at least 0.5 percent by weight nutrient agar to water to form a first solution;

(b) adding from 0.1 to 1.0 percent by weight of a nitrate compound to said first solution;

(c) sterilizing said first solution by subjecting said solution to at least 15 psig at 121° C. or greater for a period of at least 15 minutes to form a sterilized medium;

(d) adding said *Cellulomonas* sp. to the sterilized medium and allowing said *Cellulomonas* sp. to incubate for a period of from about 3 to 5 days at from about 20° C. to 40° C.; and, (e) removing resulting growth from the nutrient agar-nitrate medium.

6. The process of claim 5 wherein said sterilizing of said first medium is accomplished within a test tube on a slant whereby a slanted surface is provided for growth.

7. The process of claim 5 including the preparation of a tobacco extract broth prepared by:

(a) adding tobacco material to water to form a second solution;

(b) cooking said second solution in a vessel for at least 40 minutes at at least 15 psig at a temperature of at least 121° C.;

(c) adjusting the cooked second solution with water to approximately its original volume;

(d) mixing yeast extract at from about 0.1 to 2.0 percent by weight of extract per volume;

(e) sterilizing said second solution for at least 15 minutes at at least 15 psig at a temperature of at least 121° C.; and (f) adding the resulting growth from the nutrient agar-nitrate compound to said sterilized second solution.

8. The process of claim 1 wherein said maintaining said tobacco in contact with said microorganism is in the absence of free oxygen.

9. The process of claim 1 wherein said maintaining said tobacco in contact with said microorganism is in the presence of oxygen.

10. A process for reducing the nitrate and nicotine content of tobacco comprising the steps of:

(a) mixing tobacco into an aqueous solution;

(b) removing the tobacco from the aqueous solution whereby a tobacco extract broth is left;

(c) adding *Cellulomonas* sp. to the broth;

(d) incubating the *Cellulomonas* sp.;

(e) adding the incubated *Cellulomonas* sp. in said broth to said tobacco.

11. The process of claim 10 wherein said aqueous solution is water.

12. The process of claim 10 including the step of sterilizing said broth after step (b).

13. The process of claim 12 wherein said sterilizing is for at least 15 minutes at a pressure of at least 15 psig at a temperature of at least 121° C.

14. The process of claim 10 including the step of adding yeast extract to said broth prior to adding *Cellulomonas* sp.

15. The process of claim 14 wherein said yeast extract is from about 0.1 to 2.0 percent by weight of said broth.

16. The process of claim 10 wherein said incubating includes agitation.

17. The process of claim 10 including the step of adjusting the pH of said broth to from 7.0 to 9.5 prior to adding *Cellulomonas* sp.

18. A process for reducing the nitrate and nicotine content of tobacco comprising the steps of:

(a) mixing tobacco into an aqueous solution;

(b) removing the tobacco from the aqueous solution whereby a tobacco extract broth is left:

(c) passing said tobacco extract broth through a semi-permeable membrane, said membrane having sufficient pore size to hold a first retentate and to allow passage of preselected extract components therethrough to form a first permeate; and, (d) treating said first permeate containing the preselected extract components with *Cellulomonas* sp. to remove nitrate and nicotine.

19. The process of claim 18 including the steps of:

(e) passing said first treated permeate through a semi-permeable membrane, said membrane leaving sufficient pore size to hold a second retentate which includes said *Cellulomonas* sp. and to allow passage of treated extract therethrough, said treated extract being a second permeate;

(f) mixing said second permeate with said first retentate; and, (g) adding said second permeate and first retentate mixture to said tobacco removed in step (b).

* * * * *